US010661105B2

(12) United States Patent
Xu et al.

(10) Patent No.: US 10,661,105 B2
(45) Date of Patent: May 26, 2020

(54) RESPIRATOR AND HEAD-MOUNTED PROTECTIVE APPARATUS

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Rui Xu, Beijing (CN); Xiaochuan Chen, Beijing (CN); Haisheng Wang, Beijing (CN); Lei Wang, Beijing (CN); Ming Yang, Beijing (CN); Qian Wang, Beijing (CN); Pengcheng Lu, Beijing (CN); Peng Liu, Beijing (CN); Shengji Yang, Beijing (CN); Yingming Liu, Beijing (CN); Jiantao Liu, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 1024 days.

(21) Appl. No.: 15/147,048

(22) Filed: May 5, 2016

(65) Prior Publication Data

US 2017/0050056 A1 Feb. 23, 2017

(30) Foreign Application Priority Data

Aug. 18, 2015 (CN) ..... 2015 1 0509233

(51) Int. Cl.
*A62B 23/02* (2006.01)
*A62B 18/02* (2006.01)
(Continued)

(52) U.S. Cl.
CPC ..... *A62B 23/02* (2013.01); *A62B 7/10* (2013.01); *A62B 18/025* (2013.01); *A62B 9/006* (2013.01); *A62B 18/10* (2013.01)

(58) Field of Classification Search
CPC . A62B 23/00–06; A62B 18/02; A62B 18/025; A62B 18/04; A62B 18/045; A62B 18/06; A62B 18/08; A62B 7/10
See application file for complete search history.

(56) References Cited

U.S. PATENT DOCUMENTS 4,446,576 A 5/1984 Hisataka
5,511,541 A * 4/1996 Dearstine ..... A62B 9/003 128/201.13
(Continued)

FOREIGN PATENT DOCUMENTS

CN 201304121 Y 9/2009
CN 103402585 A 11/2013
(Continued)

OTHER PUBLICATIONS

Machine Translation of CN203457840 (Year: 2015).*
(Continued)

*Primary Examiner* — Valerie L Woodward
(74) *Attorney, Agent, or Firm* — Harness, Dickey & Pierce, P.L.C.

(57) ABSTRACT

Disclosed are a respirator and a head-mounted protection apparatus. The respirator includes a respirator body. A breathing passage is formed in the respirator body for airflow when a user breathes. The respirator further includes a filter layer switching device and at least two filter layers of different filtering properties, and the filter layer switching device is installed on the respirator body and is configured to switch filter layers below the breathing passage according to requirements. In use of the respirator, the user can transfer a filter layer of a required performance to a region below the
(Continued)

breathing passage using the filter layer switching device based on his requirement for air filtration.

12 Claims, 1 Drawing Sheet

(51) Int. Cl.

| | |
|---|---|
| ***A62B 7/10*** | (2006.01) |
| ***A62B 9/00*** | (2006.01) |
| ***A62B 18/10*** | (2006.01) |

(56) References Cited

U.S. PATENT DOCUMENTS

| | | | | |
|---|---|---|---|---|
| 2006/0130834 | A1* | 6/2006 | Chen | A62B 18/006 128/204.21 |
| 2007/0006557 | A1* | 1/2007 | Wang | A62B 18/025 55/351 |
| 2007/0068529 | A1* | 3/2007 | Kalatoor | A41D 13/11 128/206.19 |
| 2008/0245364 | A1* | 10/2008 | Patterson | A62B 7/10 128/201.25 |
| 2009/0065006 | A1* | 3/2009 | Patterson | A62B 18/025 128/205.27 |
| 2013/0104733 | A1* | 5/2013 | Bangera | A62B 23/025 95/8 |
| 2016/0121144 | A1* | 5/2016 | Hyde | A62B 7/10 128/206.11 |

FOREIGN PATENT DOCUMENTS

| | | | |
|---|---|---|---|
| CN | 103622178 | A | 3/2014 |
| CN | 203457840 | U | 3/2014 |
| CN | 103976483 | A | 8/2014 |
| CN | 203790466 | U | 8/2014 |
| CN | 104814544 | A | 8/2015 |

OTHER PUBLICATIONS

Third Office Action regarding Chinese Application No. 201510509233.9, dated Apr. 17, 2017. Translation provided by Dragon Intellectual Property Law Firm.

Second Office Action regarding Chinese application No. 201510509233.9, dated Sep. 26, 2016. Translation provided by Dragon Intellectual Property Law Firm.

Office Action regarding Chinese Patent Application No. 201510509233.9, dated Mar. 21, 2016. Translation provided by Dragon Intellectual Property Law Firm.

* cited by examiner

RESPIRATOR AND HEAD-MOUNTED PROTECTIVE APPARATUS

CROSS-REFERENCE TO RELATED APPLICATION

The present application claims priority to Chinese Patent Application No. 201510509233.9 filed on Aug. 18, 2015, the disclosure of which is incorporated in its entirety by reference herein.

TECHNICAL FIELD

The present disclosure relates to the field of protective appliances, in particular, to a respirator and a head-mounted protective apparatus.

BACKGROUND

A respirator, as common protective equipment, is widely used in daily life and industrial production, for example, a surgical respirator is used to prevent from droplet infections, an anti-dust respirator is used to avoid inhaling of dusts having diameter more than 5 micrometers per particle, an N90 or N95 respirator is used to absorb PM2.5 particles in the air, or a cotton respirator is used to keep facial temperature in a cold environment. However, with respect to different environments, a user needs to prepare a number of different respirators, and needs to replace his respirator in response to different usages required by changing occasions, and it is inconvenient to carry and use those respirators. In related technologies, filter cartridges of some respirators can be replaced, different types of filter cartridges can be replaced according to different environments so as to implement corresponding protection functions, however, many filter cartridges are still required to be carried and manually replaced, thus it is inconvenient to carry and use such respirators.

SUMMARY

It is provided a respirator in the present disclosure, in which multiple filter layers of different filtering properties are integrated. The filter layers can be switched depending on different occasions, thereby improving the convenience of use of the respirator.

Following technical solutions are provided in the present disclosure. A respirator is provided, including a respirator body. A breathing passage is formed in the respirator body for airflow caused by breathing of a user. The respirator further includes a filter layer switching device and at least two filter layers of different filtering properties, and the filter layer switching device is installed on the respirator body and is used to switch filter layers located below the breathing passage according to requirements.

During the use of the respirator, the user can transfer a filter layer of a required performance to a region below the breathing passage using the filter layer switching device based on his own requirement for air filtration. Air breathed in or breathed out by the user passes through the breathing passage via the filter layer, a particulate matter or a special gas in air of the ambient environment is filtered by the filter layer. Moreover, when air quality of the environment where the user is located is changed, a filter layer of a proper filtering performance is transferred into use by the filter layer switching device. Since corresponding filter layers of the respirator can be switched into use depending on different occasions, the use of the respirator is more convenient.

Optionally, the respirator may further include an air detection module and a control module in signal communication with the air detection module. The air detection module may be used to detect a particulate matter concentration or a special gas concentration of the air in the air outside the respirator and transmit information of the particulate matter concentration or the special gas concentration to the control module. The control module may be used to compare the information of the particulate matter concentration or the special gas concentration with a preset particulate matter concentration threshold or a preset special gas concentration threshold, and generate a filter layer switching signal in response to a determination result that the particulate matter concentration or the special gas concentration in the air outside the respirator is beyond the preset particulate matter concentration threshold or the preset special gas concentration threshold stored in the control module, and the filter layer switching device can switch the switch filtering layers below the breathing passage according to the filter layer switching signal.

Optionally, a signal generation device for generating the filter layer switching signal in the control module may be an electrical signal generating device, and the electrical signal generating device may be in signal communication with the filter layer switching device.

Optionally, a signal generation device for generating the filter layer switching signal in the control module may be an acousto-optic alarm device or a vibration alarm device, and the filter layer switching device may include a switch for controlling installment and removal of the filter layers.

Optionally, the filter layer switching device may include a filter layer retractable mechanism.

Optionally, the filter layer retractable mechanism may include a first spool and a second spool which are symmetrically arranged at two sides of the breathing passage, the first spool is rotatable about an axis of the first spool and the second spool is rotatable about an axis of the second spool. The at least two filter layers of different filtering properties are each a continuous strip and are connected with each other, two ends of the at least two filter layers of different filtering properties connected with each other are wound on the first spool and the second spool, and extended portions of the at least two filter layers of different filtering properties connected with each other are located below the breathing passage. The extended portions of the at least two filter layers of different filtering properties connected with each other are driven to move below the breathing passage by rotation of the first spool and the second spool.

Optionally, a sealing device may be disposed on the respirator body for increasing sealability between the respirator body and the face of the user.

Optionally, the sealing device may include a deformable nose clip located at a location where the respirator body is in contact with the nose of the user, or the sealing device may include a sealing strip located at a peripheral location where the respirator body is in contact with the face of the user.

Optionally, the respirator may further include a fixing band for fixing the respirator to the face of the user.

Optionally, the filter layer switching device includes a switch for controlling switching of the filter layers, and the switch may be disposed on the fixing band.

A head-mounted protection apparatus is further provided in the present disclosure, including a respirator described above.

Figure 1:
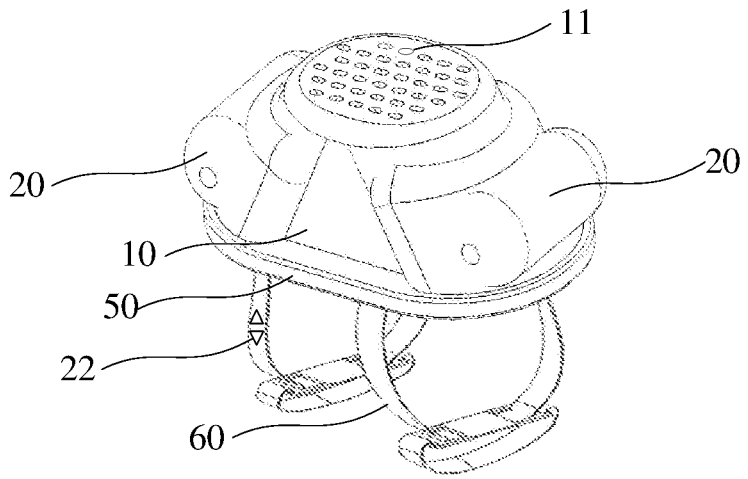
FIG. 1 is a schematic tri-dimensional structural view of a respirator according to some embodiments of the present disclosure.

Reference numerals are noted as follows:

10: respirator body; 11: breathing passage; 20: filter layer switching device; 201: first filter layer; 202 second filter layer; 21: filter layer retractable mechanism; 22: switch; 211: first spool; 212: second spool; 30: air detection module; 40: control module; 50: sealing strip; 60: fixing band.

DETAILED DESCRIPTION OF THE EMBODIMENTS

Technical solutions of the present disclosure will be described hereinafter in a clear and complete manner in conjunction with drawings in embodiments of the present disclosure. Obviously, the following embodiments are merely a part of, rather than all of, the embodiments of the present disclosure. All of the other embodiments which are obtained by a person skilled in the art based on these disclosed embodiments without paying inventive efforts are within the protective scope of the present disclosure.

Figure 2:
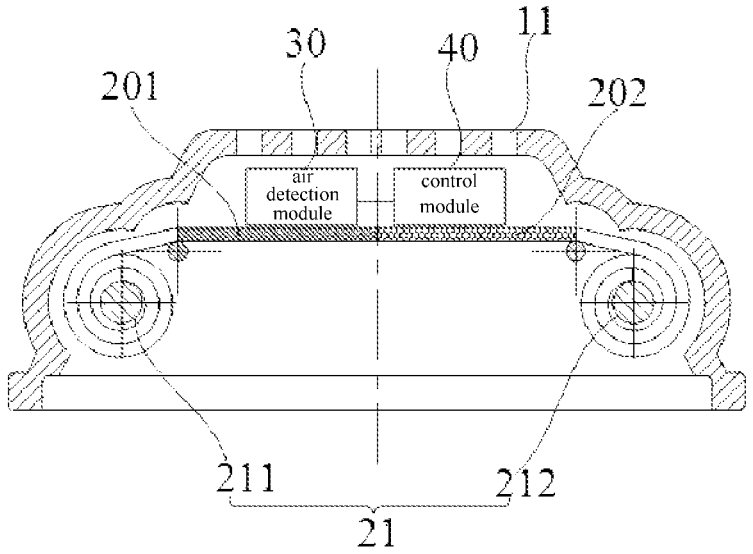
FIG. 2 is a schematic sectional view of a respirator according to some embodiments of the present disclosure.

As shown in FIG. 1 and FIG. 2, a respirator is provided according to some embodiments of the present disclosure. The respirator includes a respirator body 10, where a breathing passage 11 is formed in the respirator body 10 for airflow when a user breathes. The respirator further includes a filter layer switching device 20 and two filter layers of different filtering properties, i.e., a first filter layer 201 and a second filter layer 202. The filter layer switching device 20 is installed on the respirator body 10 and is used to switch the filtering layers below the breathing passage 11 according to requirements.

As shown in FIG. 1, in a specific embodiment, the respirator body 10 is cupped; in practice, a planer respirator body fully fitted to the face of the user may be used, so as to suit different occasions. Further, as shown in FIG. 1, the breathing passage 11 includes multiple through-holes for entrance and exit of air, which are provided in the respirator body 10 and correspond to an oronasal region of the user. In practice, a breathing passage of other structure for entrance and exit of air may be alternatively used. In addition, more than two filter layers of different filtering properties may be used for suiting various occasions.

The filter layer switching device 20 can implement automatic switching function of the filter layers according to a specific embodiment shown in FIG. 2. In the embodiment, the filter layer switching device 20 includes a filter layer retractable mechanism 21, which includes a first spool 211 and a second spool 212 which are symmetrically arranged at two sides of the breathing passage. Each of the first spool 211 and the second spool 212 is capable of rotating about its own axis. In practical, a motor is used to drive the first spool 211 and the second spool 212 to rotate. The motor can be in signal communication with a control module 40 or with a switch 22, such that the motor is automatically or manually controlled to drive the first spool 211 and the second spool 212 to rotate. The first filter layer 201 and the second filter layer 202 are each a continuous strip. A first end of the first filter layer 201 is wound on the first spool 211, a second end of the second filter layer 202 is wound on the second spool 212, and a second end of the first filter layer 201 is connected to a first end of the second filter layer 202. An extended portion of the first filter layer 201 and an extended portion of the second filter layer 202 are located below the breathing passage 11. By rotating the first spool 211 and the second spool 212, the extended portion of the first filter layer 201 and the extended portion of the second filter layer 202 are driven to move below the breathing passage 11, thereby realizing that only one type of filter layer is extended below the breathing passage 11. In practice, more than two filter layers of different filtering properties may be used for suiting various occasions.

During the use of the filter layer retractable mechanism 21, extended portions of the first filter layer 201 and the second filter layer 202 which are respectively wound on the first spool 211 and the second spool 212 are driven to move below the breathing passage 11 by rotating the first spool 211 and the second spool 212. A required filter layer is transferred to a region below the breathing passage 11 by means of controlling a rotation number of the first spool 211 and a rotation number of the second spool 212, i.e., switching of filter layers of different filter performances can be performed.

A filter layer switching device of other structure may be alternatively used for implementing switching function of the filter layers. For example, filter layers of different filtering properties which are connected end-to-end are disposed on a cyclic structure, the cyclic structure is rotated such that a certain filter layer can be located below the breathing passage 11, thereby implementing switching of the filter layers, which is not detailed herein.

During the use of the respirator, the user can transfer a filter layer of a required performance to a region below the breathing passage 11 using the filter layer switching device 20 based on his own requirement for air filtration. Air breathed in or breathed out by the user enters into or exits from the breathing passage 11 via the first filter layer 201 or the second filter layer 202, a particulate matter or a special gas in air of the ambient environment outside the respirator is filtered by the first filter layer 201 or the second filter layer 202 such that the amount of a harmful particulate matter or gas inhaled in by the user is reduced. Moreover, when the density of a particulate matter or a special gas in a current occasion is changed, the user may use the filter layer switching device 20 to switch a current filter layer into a filter layer of a corresponding filtering performance, for suiting usage requirement under the current occasion. Since corresponding filter layers of the respirator can be switched into use depending on different occasions, the use of the respirator is more convenient.

In a specific embodiment shown in FIG. 2, the respirator includes an air detection module 30 and a control module connected 40 to the air detection module 30. The air detection module 30 is used to detect a particulate matter concentration or a special gas concentration in the air outside the respirator and transmit information of the particulate matter concentration or the special gas concentration to the control module 40. The control module 40 is used to compare the information of the particulate matter concentration or the special gas concentration with a preset particulate matter concentration threshold or a preset special gas concentration threshold, and generate a filter layer switching signal in response to a determination result that the particulate matter concentration or the special gas concentration in the air outside the respirator is beyond the preset particulate matter concentration threshold or the preset special gas concentration threshold stored in the control module 40, such that the filter layer switching device 20 can switch a filter layer located below the breathing passage according to the filter layer switching signal.

In a specific embodiment, a signal generation device for generating the filter layer switching signal in the control module 40 is an electrical signal generating device, and the electrical signal generating device is in signal communication with the filter layer switching device 20. Based on the information of the particulate matter concentration or the special gas concentration detected by the air detection module 30, the control module 40 determines a filter layer of a corresponding filtering performance suited for the particulate matter concentration or the special gas concentration and transmits an electrical signal indicating switching to the determined filter layer to the filter layer switching device 20, and then the filter layer switching device 20 automatically switches the filter layer of the corresponding filtering performance to a region below the breathing passage 11, thereby satisfying usage requirements under the particulate matter concentration or the special gas concentration.

In a specific embodiment shown in FIG. 1, a signal generation device for generating the filter layer switching signal in the control module 40 is an acousto-optic alarm device or a vibration alarm device, and the filter layer switching device 20 includes a switch 22 for controlling switching of the filter layers. In response to an acousto-optic signal prompting switching of the filter layers from the acousto-optic alarm device or a vibration signal prompting switching of the filter layers from the vibration alarm device, the user can manually transfer a required filter layer into use through controlling the switch 22.

In a specific embodiment, a sealing device is disposed on the respirator body for increasing sealability between the respirator body and the face of the user.

Preferably, the sealing device includes a deformable nose clip located at a location where the respirator body is in contact with the nose of the user. Or, as shown in FIG. 1, the sealing device may include a sealing strip 50 located at a peripheral location where the respirator body is in contact with the face of the user. The sealing strip 50 may be made of a material of good air impermeability, such as silica gel.

In a specific embodiment shown in FIG. 1, the respirator further includes a fixing band 60 for fixing the respirator to the face of the user.

Preferably, in the case that the filter layer switching device includes a switch 22 for controlling switching of the filter layers, and the switch 22 may be disposed on the fixing band 60.

A head-mounted protection apparatus is further provided in the present disclosure, including a respirator described above. The head-mounted protection apparatus may be a helmet, a protective mask or the like. When the head-mounted protection apparatus is used to protect the head or the face of the user, different filter layers may be switched according to occasions of different air qualities, such that the amount of a harmful particulate matter or gas inhaled by the user is reduced, and the use of the protection apparatus is more convenient.

Obviously, various modifications to and variations of the embodiments of the present disclosure may be made by the skilled in the art without departing from the spirit and scope of the present disclosure. Thus, if these modifications and variations fall within scope of the appended list of claims of the present disclosure or technical equivalents thereof, the present disclosure also intends to contain these modifications and variations.

What is claimed is:

1. A respirator comprising:

a respirator body, wherein a breathing passage is formed in the respirator body for airflow caused by breathing of a user;

a filter layer switch;

at least two filter layers, each of the at least two filter layers having a different filtering property in an unused condition than another of the at least two filter layers, the filter layer switch being installed on the respirator body for switching filtering layers below the breathing passage;

an air detection module; and a control module in signal communication with the air detection module, wherein the filter layer switch includes a first spool and a second spool configured as a filter layer retractor, the first spool and the second spool being symmetrically arranged at two sides of the breathing passage, the first spool being rotatable about an axis of the first spool, the second spool being rotatable about an axis of the second spool, wherein the at least two filter layers are each a continuous strip and are connected with each other, two ends of the at least two filter layers connected with each other being wound on the first spool and the second spool, and extended portions of the at least two filter layers connected with each other being located below the breathing passage, wherein the extended portions of the at least two filter layers connected with each other are capable of moving below the breathing passage in both direction by rotation of the first spool and the second spool, wherein the air detection module is configured to detect a particulate matter concentration or a special gas concentration in the air outside the respirator and transmit information of the particulate matter concentration or the special gas concentration to the control module, and wherein the control module is configured to compare the information of the particulate matter concentration or the special gas concentration with a preset particulate matter concentration threshold or a preset special gas concentration threshold, and generate a filter layer switching signal in response to a determination result that the particulate matter concentration or the special gas concentration in the air outside the respirator is beyond the preset particulate matter concentration threshold or the preset special gas concentration threshold stored in the control module, and the filter layer switch switches the filter layers below the breathing passage according to the filter layer switching signal.

2. The respirator according to claim 1, wherein a signal generation device for generating the filter layer switching signal in the control module is an electrical signal generating device, and the electrical signal generating device is in signal communication with the filter layer switch.

3. The respirator according to claim 1, wherein a signal generation device for generating the filter layer switching signal in the control module is an acousto-optic alarm device or a vibration alarm device, and the filter layer switch includes a manual switch for controlling switching of the filter layers.

4. The respirator according to claim 1, wherein a rotation direction of the first spool is identical to a rotation direction of the second spool.

5. The respirator according to claim 1, wherein the extended portions of the at least two filter layers connected with each other are closely fitted to the respirator body at a region where the breathing passage is located.

6. The respirator according to claim 1, further comprising a seal disposed on the respirator body and being configured to contact a face of the user.

7. The respirator according to claim 6, further comprising a respirator substrate, wherein the seal includes a sealing strip located on a periphery of the respirator body.

8. The respirator according to claim 1, further comprising a fixing band for fixing the respirator to the face of the user.

9. The respirator according to claim 8, wherein the filter layer switch includes a switch for controlling switching of the filter layers, and the switch is disposed on the fixing band.

10. A head-mounted protection apparatus comprising:

a respirator;

an air detection module; and a control module in signal communication with the air detection module, wherein the respirator includes a respirator body, a filter layer switch, and at least two filter layers, each of the at least two filter layers having a different filtering property in an unused condition than another of the at least two filter layers, a breathing passage being formed in the respirator body for airflow caused by breathing of a user, the filter layer switch being installed on the respirator body for switching filtering layers below the breathing passage, wherein the filter layer switch includes a first spool and a second spool configured as a filter layer retractor, the first spool and the second spool being symmetrically arranged at two sides of the breathing passage, the first spool being rotatable about an axis of the first spool and the second spool being rotatable about an axis of the second spool, wherein the at least two filter layers are each a continuous strip and are connected with each other, two ends of the at least two filter layers connected with each other being wound on the first spool and the second spool, and extended portions of the at least two filter layers connected with each other being located below the breathing passage, wherein the extended portions of the at least two filter layers connected with each other are capable of moving below the breathing passage in both direction by rotation of the first spool and the second spool, wherein the air detection module is configured to detect a particulate matter concentration or a special gas concentration in the air outside the respirator and transmit information of the particulate matter concentration or the special gas concentration to the control module, and wherein the control module is configured to compare the information of the particulate matter concentration or the special gas concentration with a preset particulate matter concentration threshold or a preset special gas concentration threshold, and generate a filter layer switching signal in response to a determination result that the particulate matter concentration or the special gas concentration of the air outside the respirator is beyond the preset particulate matter concentration threshold or the preset special gas concentration threshold stored in the control module, and the filter layer switch switches the filter layers below the breathing passage according to the filter layer switching signal.

11. The head-mounted protection apparatus according to claim 10, wherein a rotation direction of the first spool is identical to a rotation direction of the second spool.

12. The head-mounted protection apparatus according to claim 10, wherein the extended portions of the at least two filter layers connected with each other are closely fitted to the respirator body at a region where the breathing passage is located.

* * * * *